US012729608B1

(12) United States Patent
Novelen

(10) Patent No.: US 12,729,608 B1
(45) Date of Patent: Sep. 8, 2026

(54) ADJUSTABLE SCREEN SIZE USING INTERCHANGEABLE SHROUDS

(71) Applicant: Halliburton Energy Services, Inc., Houston, TX (US)

(72) Inventor: Ryan Novelen, Euless, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/254,112

(22) Filed: Jun. 30, 2025

(51) Int. Cl.
*E21B 43/10* (2006.01)

(52) U.S. Cl.
CPC ..... *E21B 43/108* (2013.01)

(58) Field of Classification Search
CPC ..... E21B 43/08; E21B 43/108
See application file for complete search history.

(56) References Cited

U.S. PATENT DOCUMENTS

2002/0179302 A1* 12/2002 Nguyen ..... E21B 43/084 166/383
2005/0279510 A1* 12/2005 Patel ..... E21B 33/12 166/380
2008/0006413 A1* 1/2008 Le Gloahec ..... E21B 43/084 166/227
2008/0035330 A1* 2/2008 Richards ..... E21B 43/08 166/228
2011/0226481 A1* 9/2011 Duphorne ..... E21B 43/12 166/313
2014/0027108 A1* 1/2014 Lopez ..... E21B 43/108 166/207
2014/0110132 A1* 4/2014 Cunningham ..... E21B 43/10 166/51
2014/0116727 A1* 5/2014 Cunningham ..... E21B 43/08 166/227
2016/0003014 A1* 1/2016 Gano ..... E21B 43/04 166/278
2016/0194941 A1* 7/2016 Greci ..... E21B 43/084 166/227
2016/0290110 A1* 10/2016 Novelen ..... E21B 43/084
2016/0376876 A1* 12/2016 Provost ..... E21B 43/08 166/278
2018/0002989 A1* 1/2018 Veit ..... E21B 17/046
2018/0266218 A1* 9/2018 Greci ..... E21B 34/08
2021/0348448 A1* 11/2021 Er ..... E21B 17/18
2025/0283381 A1* 9/2025 Greci ..... E21B 17/026

* cited by examiner

*Primary Examiner* — Shane Bomar

(57) ABSTRACT

A well screen assembly may be used for flow and sand control in a tubing string within the wellbore in downhole operations. The well screen assembly includes at least two filtration layers are disposed around a base pipe. Each filtration layer is configured to filter particulates from the fluid as the fluid flows through the filtration layers and into a bore of the base pipe. Additionally, outer shrouds are disposed about respective filtration layers and removably coupled to the base pipe. The outer shrouds can be solid outer shrouds for blocking fluid communication between an exterior of the outer shroud and the filtration layer or perforated outer shrouds for allowing fluid communication between the exterior and the filtration layer. The outer shrouds are interchanged to allow the use and blocking of different filtration layer.

20 Claims, 9 Drawing Sheets

ADJUSTABLE SCREEN SIZE USING INTERCHANGEABLE SHROUDS

BACKGROUND

This section is intended to provide relevant background information to facilitate a better understanding of the various aspects of the described embodiments. Accordingly, it should be understood that these statements are to be read in this light and not as admissions of prior art.

Hydrocarbons, such as oil and gas, are commonly obtained from subterranean formations that may be located onshore or offshore. To produce hydrocarbons, a wellbore is drilled through a hydrocarbon-bearing zone in a reservoir of the subterranean formations. In hydrocarbon production operations, it may be useful to convey tubular equipment into the wellbore to produce to the surface from the reservoir. Gravel packs and sand screens that have been employed in the tubular equipment are used for filtering geologic fluids during production operations. However, gravel packs and sand screens are typically limited to one size screen or filter with no means to adjust a screen flow aperture before being deployed in the wellbore.

BRIEF DESCRIPTION OF THE DRAWINGS

Aspects of the disclosure are described with reference to the following figures. The same or sequentially similar numbers are used throughout the figures to reference like features and components. The features depicted in the figures are not necessarily shown to scale. Certain features may be shown exaggerated in scale or in somewhat schematic form, and some details of elements may not be shown in the interest of clarity and conciseness.

DETAILED DESCRIPTION

The present disclosure describes a well screen assembly for flow and sand control for a tubing string within the wellbore in both production and injection operations. For example, the well screen assembly may be used to filter a fluid from the wellbore. The well screen assembly includes a base pipe defining an interior bore. The base pipe has fluid passageways configured to provide fluid communication between the wellbore (or an exterior of the base pipe) and the interior bore for the fluid. At least two filtration layers are disposed around the base pipe at different axial locations along the pipe. Each filtration layer is configured to filter particulates from the fluid as the fluid flows through the filtration layers and into the interior bore. For example, each filtration layer may have one aperture size, such as a coarse screen, a medium screen, or a fine screen, to filter a specified size of particulates in the fluid. The fine screen may have the smallest aperture size, the coarse screen may have the largest aperture size, and the medium screen may have an aperture size larger than the fine screen but smaller than the coarse screen. Additionally, outer shrouds are disposed about respective filtration layers and removably coupled to the base pipe. Each outer shroud may be used to surround each filtration layer and isolate adjacent filtration layers from each other. The outer shrouds can be solid outer shrouds for blocking fluid communication between an exterior of the outer shroud and the filtration layer or perforated outer shrouds for allowing fluid communication between the exterior and the filtration layer. The outer shrouds are interchanged to allow the use and blocking of different filtration layer. A configuration of solid and perforated outer shrouds is based on selected filtration layers for use in filtering the fluid in the wellbore. It is further envisioned that well data may be used for determining the configuration of solid and perforated outer shrouds before lowering the well screen assembly into the wellbore. By using both the interchange outer shrouds, the well screen assembly of the present disclosure allows for more precise sand control of individual wells or zones, and more efficient and adaptable sand management in production and injection operations. Additionally, the well screen assembly of the present disclosure also allows for screen aperture adjustment post-manufacture at a well site based on downhole filtration requirements such as utilizing a coarse screen, a medium screen, or a fine screen to filter different size particulates. Further, because the well screen assembly is not limited to one aperture size of the filtration layers, the well screen assembly may be used in a variety of wells with different fluid compositions (e.g., different sizes solids in the fluid).

Figure 1:
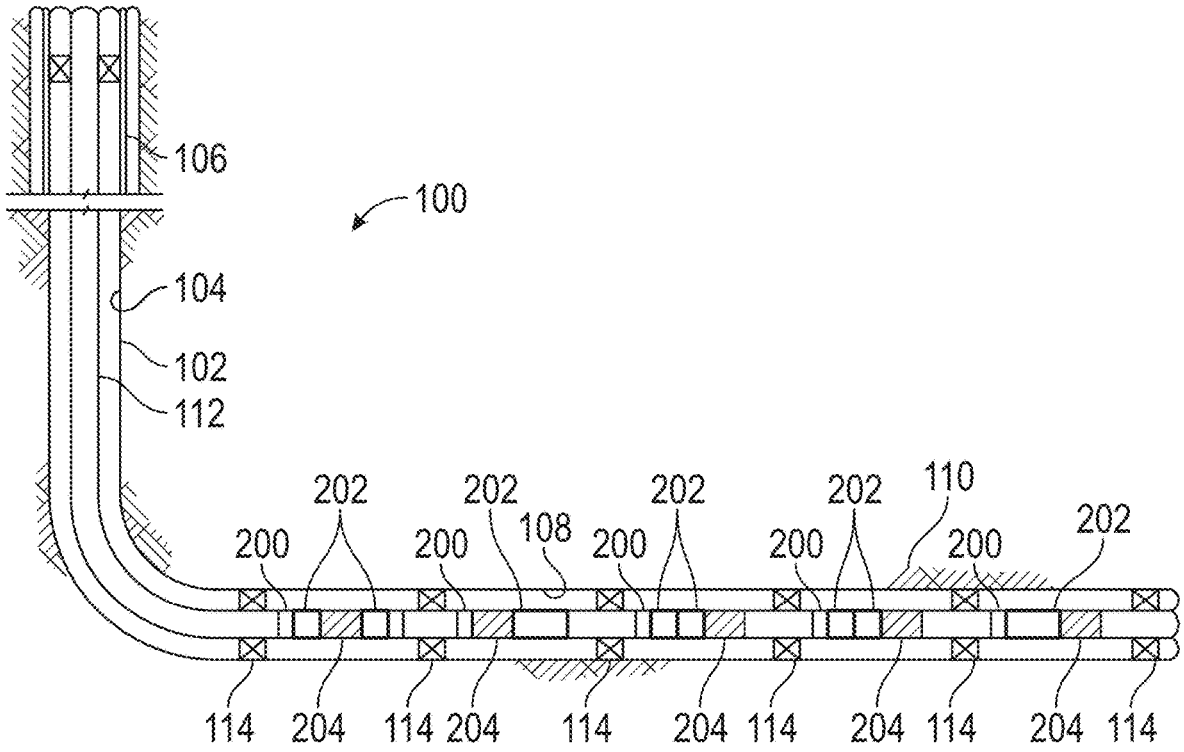
FIG. 1 illustrates a schematic view of a wellbore system in accordance with one or more embodiments

FIG. 1 is a schematic illustration of a wellbore system 100 includes a plurality of well screen assemblies 200 in accordance with one or more embodiments. While only five well screen assemblies 200 are shown in the wellbore system 100, this is for example purpose only and any number of well screen assemblies 200 may be used without departing from the scope of the present invention. A wellbore 102 extends through various earth strata. The wellbore 102 has a substantially vertical section 104, the upper portion of which has installed therein a casing string 106. The wellbore 102 also has a substantially deviated section 108, shown as horizontal, which extends through a subterranean formation 110, such as a hydrocarbon-bearing formation. As illustrated, substantially horizontal section 108 of the wellbore 102 is open hole. While shown here in an open hole, horizontal section of a wellbore, the well screen assemblies 200 will work in any orientation, and in open or cased hole. Additionally, while the wellbore system 100 is shown as a completed well, this for example purposes only, and the well screen assemblies may be used with injection systems.

Positioned within the wellbore 102 and extending from the surface is a tubing string 112. The tubing string 112 provides a conduit for a fluid to travel from the subterranean formation 110 upstream to the surface. Positioned within the tubing string 112 in the various production intervals adjacent to the subterranean formation 110 are the plurality of well screen assemblies 200 having one or more solid outer shrouds 202 and a perforated outer shroud 204. At either end of each production tubing section 24 is a packer 26 that provides a fluid seal between the tubing string 112 and the wall of the wellbore 102. The space in-between each pair of adjacent packers 114 defines a production interval.

In one or more embodiments, each of the well screen assemblies 200 includes sand control capabilities by having at least one solid outer shrouds 202 and at least one perforated outer shroud 204. In some embodiments, the well screen assemblies 200 may include only perforated outer shrouds 204 with no solid outer shrouds 202. Alternatively, the well screen assemblies 200 may include only solid outer shrouds 202 with no perforated outer shrouds 204 to form downhole storage chambers between the solid outer shrouds 202 and the well screen assemblies 200. Underneath the perforated outer shrouds 204 and the solid outer shrouds 202, filtration layers are disposed about the well screen assemblies 200.

The perforated outer shrouds 204 having a plurality of perforations therethrough may be positioned around the exterior of any such filtration layers. The plurality of perforations may be a pattern of elongated perforations therein, which permits a fluid to pass radially through the perforated outer shrouds 204. The plurality of perforations may also provide a predetermined degree of compliance to the perforated outer shrouds 204 that permit the well screen assemblies 200 to expand radially to a predetermined diameter. The solid outer shrouds 202 have no perforations to block any flow around the exterior of any such filtration layers. The filtration layers, such as sand control screen elements or filter media associated with downhole fluid filtration, are designed to allow the fluid to flow therethrough but prevent a specified size of particulates within the fluid from flowing therethrough.

In one or more embodiments, the well screen assemblies 200 are operate to filter particulate matter out of the fluid collected from the subterranean formation 110 and may include flow restrictors therein to regulate the flow therethrough during production operations. Alternatively, or additionally, the well screen assemblies 200 may be operable to control and filter the flow of an injection fluid stream from the tubing string 112 into the subterranean formation 110. It is further envisioned that while the well screen assemblies 200 are illustrated with diameter smaller than a wellbore diameter, the solid outer shrouds 202 and the perforated outer shroud 204 may be expanded to contact the wall of the wellbore 102.

Figure 2:
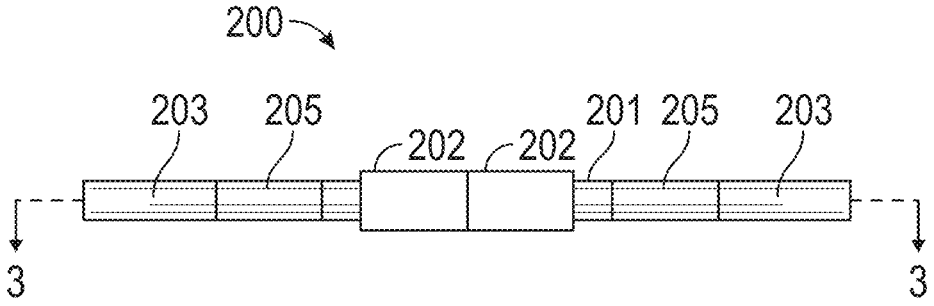
FIG. 2 shows a side view of a well screen assembly in accordance with one or more embodiments.

Now referring to FIG. 2, a side view of the well screen assembly 200 is illustrated in accordance with one or more embodiments. The well screen assembly 200 includes a base pipe 201 having opposing connection ends 203 to connect the well screen assembly 200 to a tubing string. The connection ends 203 may be threaded pin and box-type connections. In some embodiments, the base pipe 201 may include opposing transition sections 205 provide axially and radially support to the well screen assembly 200 when configured to expand against a wall of the wellbore. It is further envisioned that the base pipe 201 may be manufactured as a single-piece or in sections and coupled together.

Figure 3:
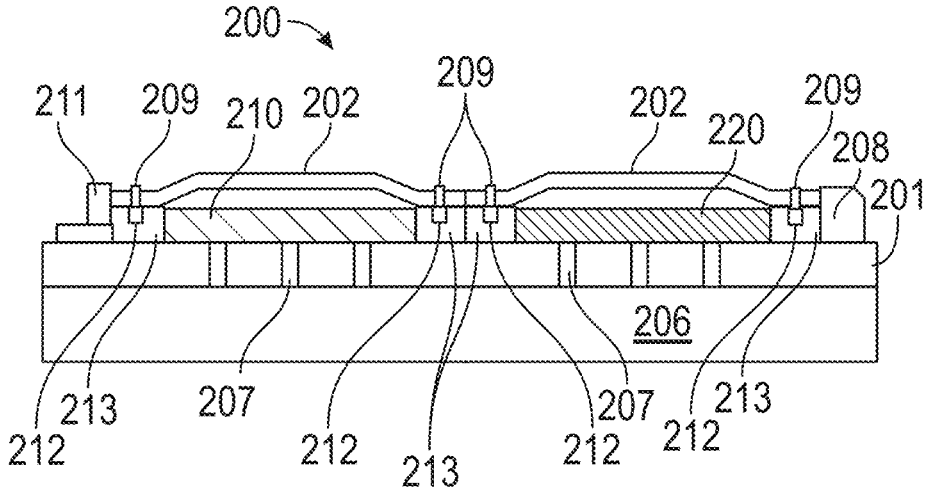
FIG. 3 shows a cross-sectional view of the well screen assembly of FIG. 2 in accordance with one or more embodiments.

FIG. 3 illustrates a partial cross-sectional view of the well screen assembly 200 taken along line 3-3 of FIG. 2 to shown a screen assembly of the well screen assembly 200. The base pipe 201 defines an interior bore 206 in fluid communication with a tubing string. Additionally, the base pipe 201 defines fluid passageways 207 configured to provide fluid communication between an exterior of the base pipe 201 and the interior bore 206 for a fluid produced from a formation or injected into the formation.

Filtration layers 210, 220 are disposed around the base pipe 201 at different axial locations along the base pipe 201. Each of the filtration layers 210, 220 may be constructed as a filtration screen sheet, such as a sheet of wire mesh, composite mesh, plastic mesh, micro-perforated or sintered sheet metal or plastic sheeting, and/or any other sheet material capable of being used to form a tubular covering over the base pipe 201 and filter against passage of particulate larger than a specified size. A first filtration layer 210 and a second filtration layer 220 may be arranged in series along a length of the base pipe 201. Each of the filtration layers 210, 220 are configured to filter particulates from a fluid as the fluid flows through the respective filtration layers 210, 220 and into the interior bore 206. For example, the first filtration layer 210 includes a first aperture size configured to trap and prevent the flow of a first specified size of particulates therethrough. The second filtration layer 220 includes a second aperture size configured to trap and prevent the flow of a second specified size of particulates therethrough. The first aperture size may be larger than the second aperture size such that the second specified size of particulates is smaller than the first specified size of particulates. In such an aperture size configuration, the first aperture size defines the first filtration layer 210 as a coarse screen and the second aperture size defines the second filtration layer 220 as a fine screen. For example, the first aperture size for the coarse screen may be openings having a size of approximately 300 microns. The second aperture size for the fine screen may be openings having a size of approximately 125 microns. In some embodiments, the first aperture size or the second aperture size may have openings with a size of approximately 200 microns or a size ranging between 125 microns to 300 microns thereby defining a medium screen for the respective filtration layer. The size of the openings for the respective apertures prevents any particulates that are larger than the size of the openings from passing through the respective filtration layer.

In one or more embodiments, the well screen assembly 200 is initially assembled or manufactured to have the only solid outer shrouds 202 disposed around the filtration layers 210, 220 and removably coupled to the base pipe 201. For example, one end of a respective solid outer shroud 202 may be inserted into a cap 208 and a snap rings 209 may be used to lock the ends of the respective solid outer shroud 202 to the base pipe 201 over the second filtration layer 220. The other solid outer shroud 202 may be locked over the first filtration layer 210 via a locking mechanism 211 and the snap rings 209. The locking mechanism 211 may be thread rod and nut assembly or any type of mechanic fastener. Additionally, seals 212, such as an O-ring or elastomer seal, may be provide between ends 213 of the filtration layers 210, 220 and the respective solid outer shrouds 202. The seals 212 help fluidly isolate the filtration layers 210, 220 from each other to avoid or prevent any flow between the adjacent filtration layers 210, 220.

With the solid outer shrouds 202 removably coupled over the filtration layers 210, 220, the well screen assembly 200 is transported to a well site or storage facility. At the well site or storage facility, the solid outer shrouds 202 help protect the filtration layers 210, 220 from any pre-installation or pre-deployment damage. Before the well screen assembly 200 can be lowered or deployed into a wellbore, well data may be collected to determine which of the filtration layers 210, 220 to use.

In one or more embodiments, the well data may be collected from previous drilling operations. For example, the well data may be provided from well analysis that is completed in the drilling phase of the wellbore (e.g., measurement while drilling (MWD) or logging while drilling (LWD)) or provided from like-wells or an offset well. In some embodiments, the well analysis may be a sane well analysis (or sand sieve analysis) to determine a particle size distribution of a sand (i.e., the fluid) within the well. The well data may include information such as fluid properties of the fluid from the wellbore. The collected data is then analyzed to determine a composition of the fluid. The composition of the fluid may be used to determine the specified size of particulates to be filtered from the fluid to provide a clean or filtered wellbore fluid. For example, the specified size of particulates to filter may be based on collected well data that includes a composition of the fluid. For example, if the specified size of particulates to be filtered is too small for the first filtration layer 210 to filter, the second filtration layer 220 may be utilized. Once one of the filtration layers 210, 220 is selected for use, the corresponding solid outer shroud 202 may be replaced with a configuration of solid and perforated outer shrouds 202, 204 based on the selected filtration layers 220 for use in filtering the fluid in the wellbore.

Figure 4:
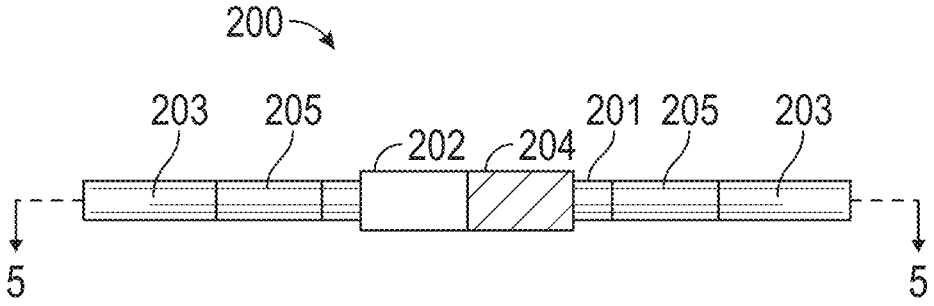
FIG. 4 shows a side view of the well screen assembly of FIG. 2 with outer shrouds switched out in accordance with one or more embodiments.
Figure 5:
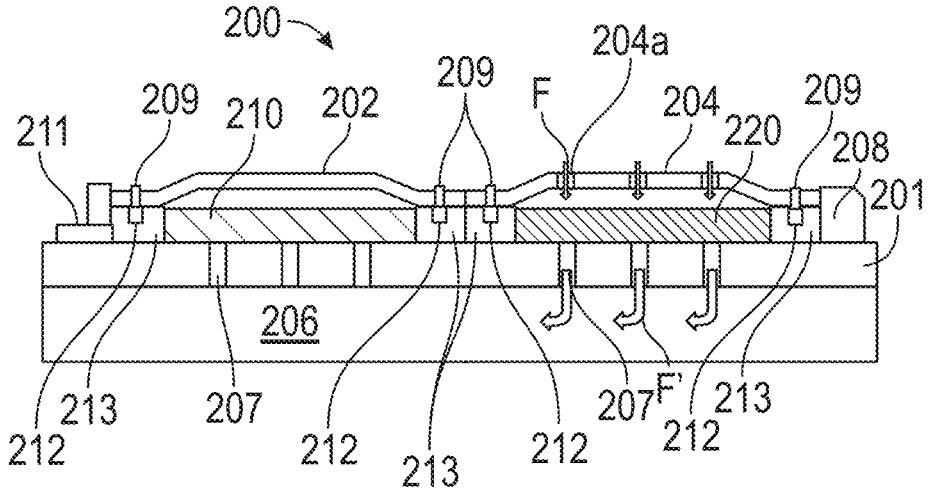
FIG. 5 shows a cross-sectional view of the well screen assembly of FIG. 4 in accordance with one or more embodiments.

As shown on FIGS. 4 and 5, the second filtration layer 220 is determined to the selected filtration layer. The solid outer shroud disposed about the second filtration layer 220 is switched out for the perforated outer shroud 204. To switch the outer shrouds, the locking mechanism 211 is unlocked. For example, a thread rod of the locking mechanism 211 is unscrewed from the base pipe 201 such the solid outer shrouds 202 may be pulled out from the snap rings 209. With the solid outer shrouds 202 removed, the perforated outer shroud 204 may be inserted into the cap 208 to be disposed around the second filtration layer 220. The snap rings 209 may then be reapplied to the ends of the perforated outer shroud 204 over the ends 213 of the second filtration layer 220. Additionally, the solid outer shroud 202 is then relocked over the first filtration layer 210 via the locking mechanism 211 and the snap rings 209. The second filtration layer 220 is now ready to be deployed or lowered in the wellbore via a tubing string coupled to the base pipe 201.

The perforated outer shroud 204 includes perforations 204*a* to allow the fluid flow therethrough (see arrow F). Once the fluid flows through the perforated outer shroud 204, the fluid flows through the second filtration layer 220. The second filtration layer 220 filters a specified size of particulates from the fluid such that clean or filtered fluid without the specified size of particulates flows through the fluid passageways 207 and into the interior bore 206 (see arrow F'). As the solid outer shroud 202 is locked over the first filtration layer 210, the fluid is blocked from flowing through the first filtration layer 210.

Figure 6:
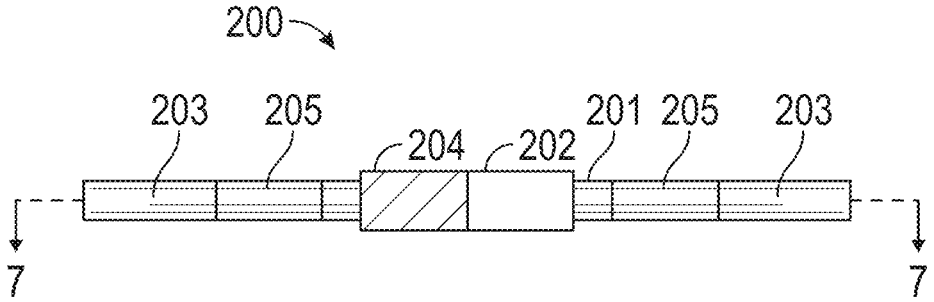
FIG. 6 shows a side view of the well screen assembly of FIG. 2 with outer shrouds switched out in accordance with one or more embodiments.
Figure 7:
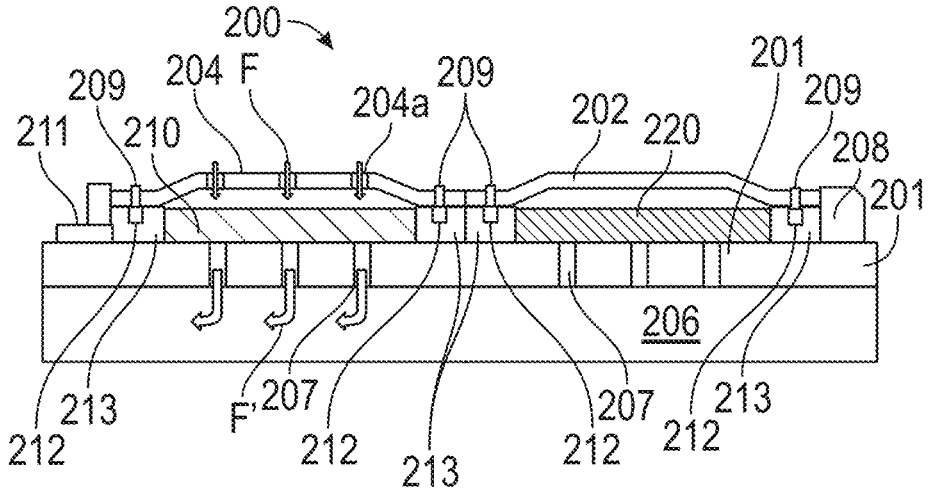
FIG. 7 shows a cross-sectional view of the well screen assembly of FIG. 6 in accordance with one or more embodiments.

Now referring to FIGS. 6 and 7, a side view and partial cross section perspective cutaway views of the well screen assembly 200 are illustrated in accordance with one or more embodiments, where like numerals represent like parts. The well screen assembly 200 of FIGS. 6 and 7 is similar to that of the well screen assembly 200 of FIGS. 4 and 5. However, instead of the solid outer shroud 202 being over the first filtration layer 210 and the perforated outer shroud 204 being over the second filtration layer 220, the perforated outer shroud 204 is over the first filtration layer 210 and the solid outer shroud 202 is over the second filtration layer 220.

Figure 8:
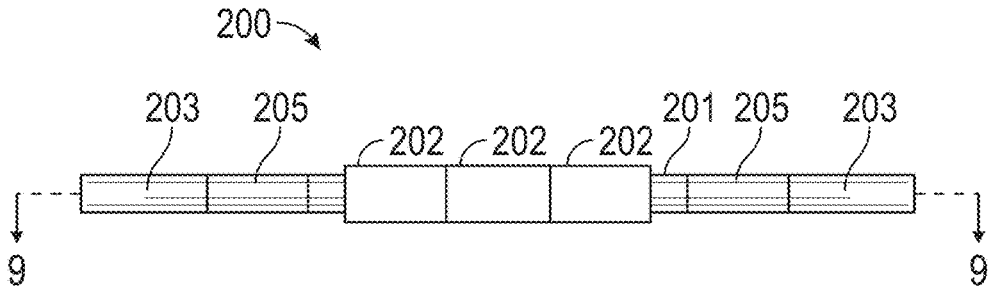
FIG. 8 shows a side view of a well screen assembly in accordance with one or more embodiments.
Figure 9:
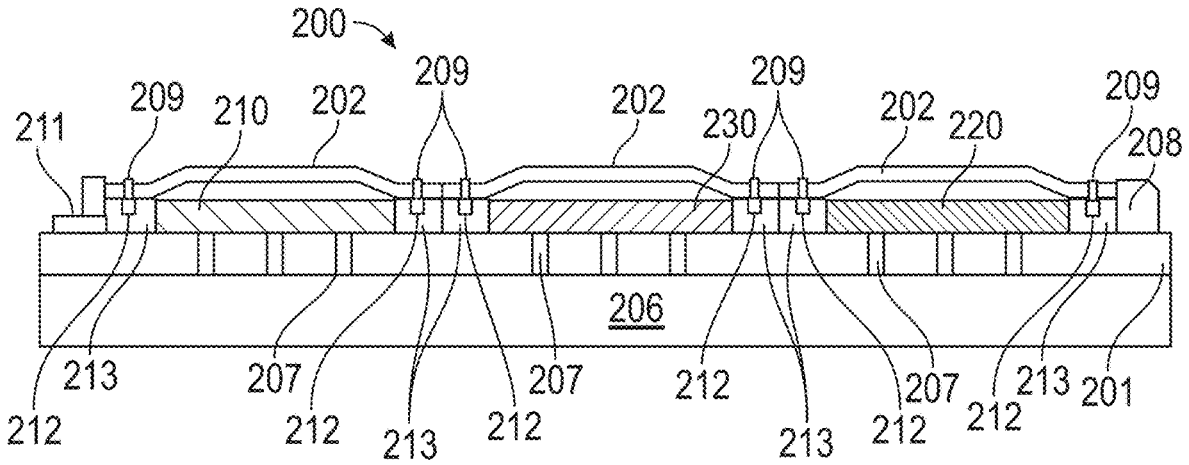
FIG. 9 shows a cross-sectional view of the well screen assembly of FIG. 8 in accordance with one or more embodiments.

Turning to FIGS. 8 and 9, a side view and partial cross section perspective cutaway views of the well screen assembly 200 are illustrated in accordance with one or more embodiments, where like numerals represent like parts. The well screen assembly 200 of FIGS. 8 and 9 is similar to that of the well screen assembly 200 of FIGS. 2 and 3. However, instead of two of the solid outer shrouds 202, the well screen assembly 200 may include three of the solid outer shrouds 202. Additionally, a third filtration layer 230 is provided axially spaced along the base pipe 201. In some embodiments, the third filtration layer 230 may be positioned between the first filtration layer 210 and the second filtration layer 220. It is further envisioned that the first filtration layer 210, the second filtration layer 220, and the third filtration layer 230 may be axially positioned in any order along the base pipe 201. The third filtration layer 230 has a third specified size of particulates that is larger than the second specified size of particulates of the second filtration layer 220 but smaller than the first specified size of particulates of the first filtration layer 210. In such an aperture size configuration, the first aperture size defines the first filtration layer 210 as a coarse screen, the third aperture size defines the third filtration layer 230 as a medium screen, and the second aperture size defines the second filtration layer 220 as a fine screen. For example, the first aperture size for the coarse screen may be openings having a size of approximately 300 microns. The third aperture size for the medium screen may be openings having a size of approximately 200 microns. The second aperture size for the fine screen may be openings having a size of approximately 125 microns.

Figure 10:
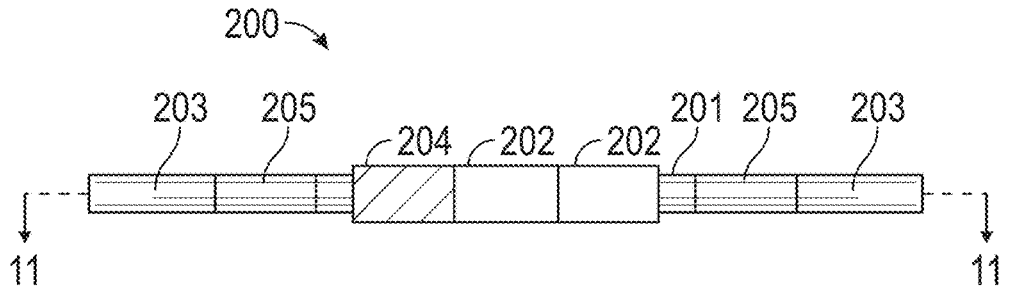
FIG. 10 shows a side view of the well screen assembly of FIG. 8 with outer shrouds switched out in accordance with one or more embodiments.
Figure 11:
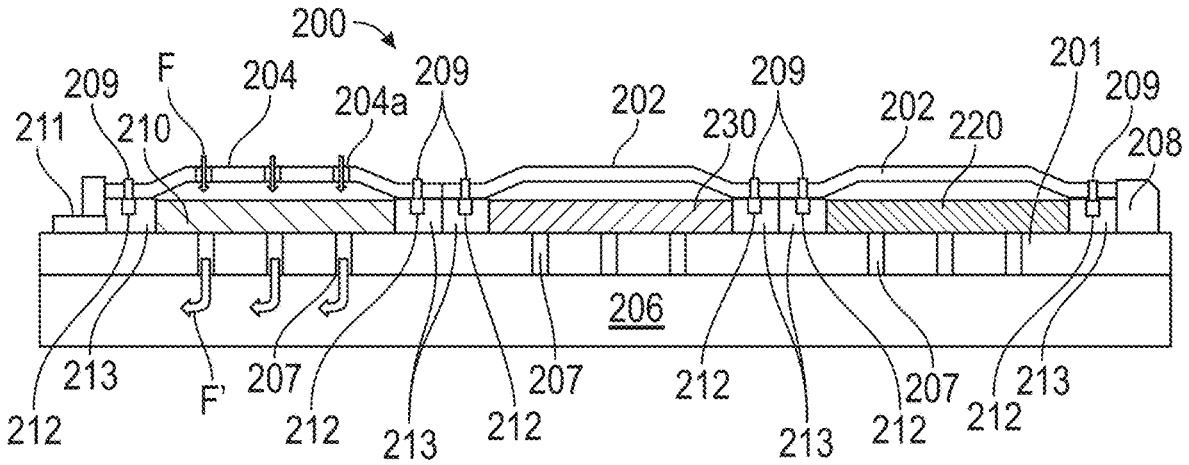
FIG. 11 shows a cross-sectional view of the well screen assembly of FIG. 10 in accordance with one or more embodiments.
Figure 12:
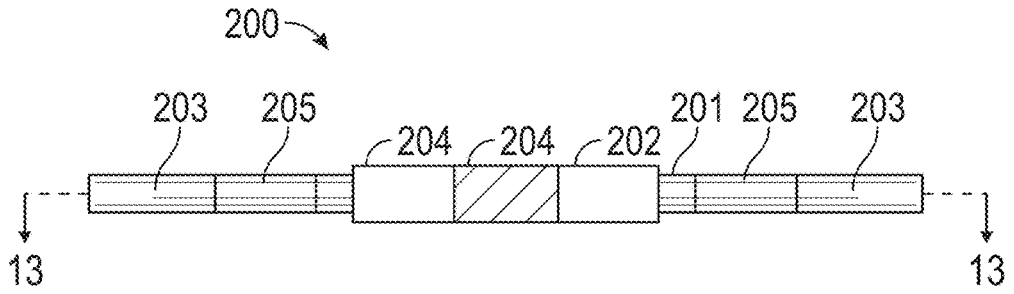
FIG. 12 shows a side view of the well screen assembly of FIG. 8 with outer shrouds switched out in accordance with one or more embodiments.
Figure 13:
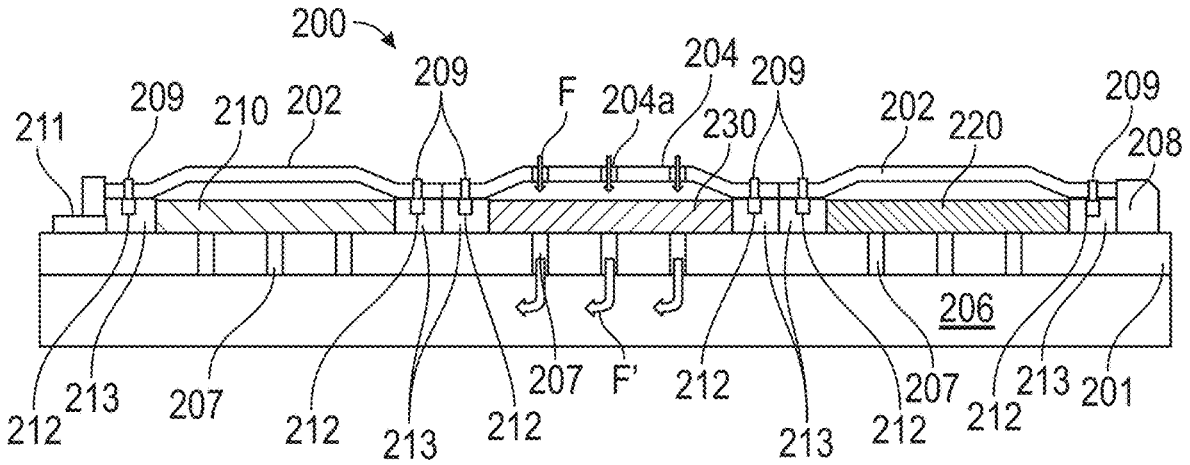
FIG. 13 shows a cross-sectional view of the well screen assembly of FIG. 12 in accordance with one or more embodiments.
Figure 14:
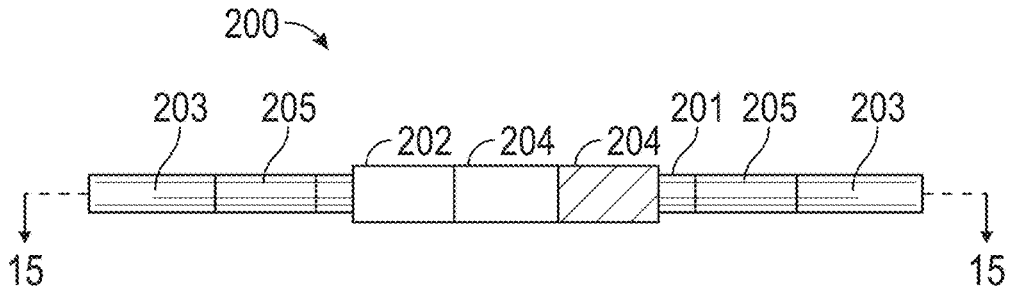
FIG. 14 shows a side view of the well screen assembly of FIG. 8 with outer shrouds switched out in accordance with one or more embodiments.
Figure 15:
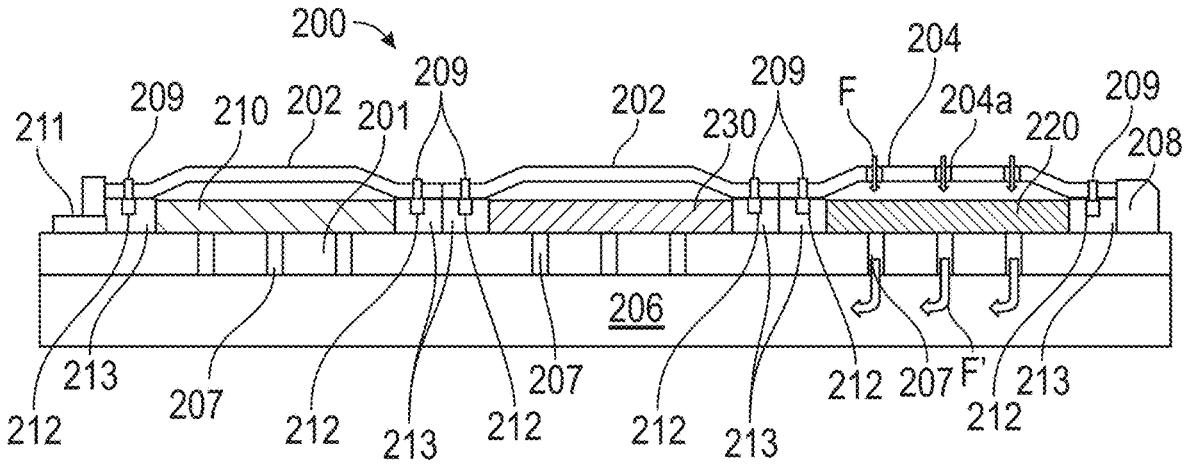
FIG. 15 shows a cross-sectional view of the well screen assembly of FIG. 14 in accordance with one or more embodiments.

Now referring to FIGS. 10-15. FIGS. 10-15 illustrate one or more embodiments of the well screen assembly 200 of FIG. 8 having one perforated outer shroud 204 and two solid outer shrouds 202. For example, FIGS. 10 and 11 shows when the perforated outer shroud 204 is locked about the first filtration layer 210, while the two solid outer shrouds 202 are locked about the second filtration layer 220 and the third filtration layer 230. The process of unlocking and locking the respective outer shrouds 204, 202 over the corresponding filtration layer 210, 220, 230 is the same method as those described above with respect to the cap 208, the locking mechanism 211, the snap rings 209, and the seals 212. FIGS. 12 and 13 shows when the perforated outer shroud 204 is locked about the third filtration layer 230, while the two solid outer shrouds 202 are locked about the first filtration layer 210 and the second filtration layer 220. FIGS. 14 and 14 shows when the perforated outer shroud 204 is locked about the second filtration layer 220, while the two solid outer shrouds 202 are locked about the first filtration layer 210 and the third filtration layer 230.

Figure 16:
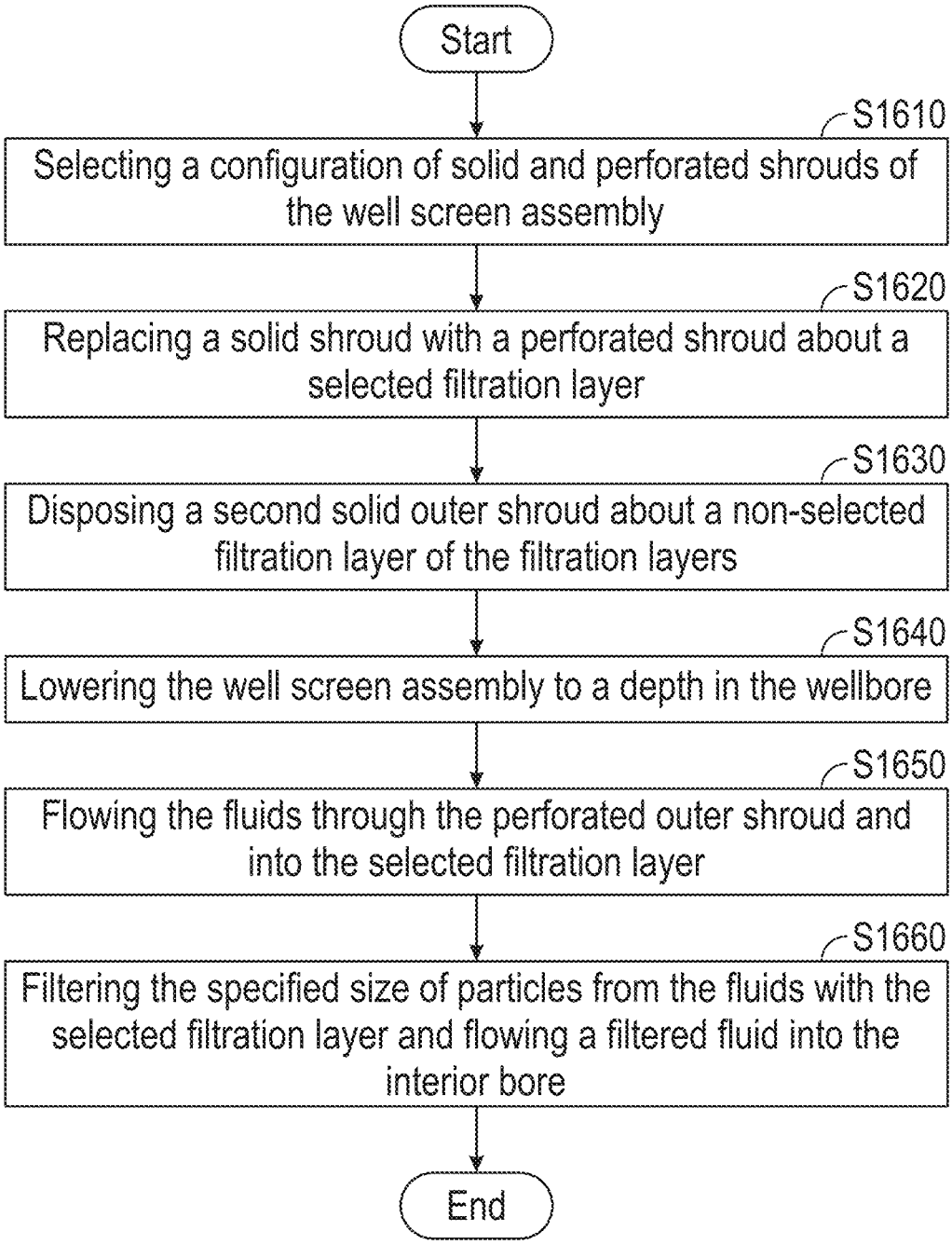
FIG. 16 a flow chart of an example method for operating a well screen assembly in accordance with one or more embodiments.

FIG. 16 is a flow chart of an example method for deploying and operating the well screen assembly 200 described above in FIGS. 1-15. One or more steps in FIG. 16 may be performed by one or more components (e.g., a computing system coupled to a controller in communication with the well screen assembly and various equipment at a well) as described in FIGS. 1-15. For example, a non-transitory computer readable medium may store instructions on a memory coupled to a processor such that the instructions include functionality for operating the well screen assembly. While the various steps in FIG. 16 are presented and described sequentially, one of ordinary skill in the art will appreciate that some or all of the steps may be executed in different orders, may be combined or omitted, and some or all of the steps may be executed in parallel.

In S1610, a configuration of solid and perforated outer shrouds of the well screen assembly is selected based on a specified size of particulates to filter from the fluid. For example, well data that includes fluid properties of the fluid from the wellbore is collected. This well data may have been recorded during the drilling phase of the wellbore or may be measured from similar wellbore or offset wells. To determine a composition of the fluid, the well data is analyzed. Based on the well data, a specified size of particulates that needs to filtered from the fluid is determined. Additionally, a selected filtration layer disposed about the base pip is selected for deployment into the wellbore by having an aperture size selected for a coarse screen, a medium screen, or a fine screen that corresponds to the specified size of particulates.

In S1620, a solid outer shroud disposed about a selected filtration layer is replaced with a perforated outer shroud. For example, a locking mechanism is unlocked and the solid outer shroud is slid under a snap ring to expose the selected filtration layer. The perforated outer shroud is then disposed around the selected filtration layer. A snap ring is reapplied to an end of the perforated outer shroud and the locking mechanism is relocked to lock the perforated outer shroud to the base pipe of the well screen assembly. The perforated outer shroud allows fluid communication between the wellbore and the selected filtration layer In S1630, a second solid outer shroud is disposed about a non-selected filtration layer of the filtration layers. The second solid outer shroud is coupling to the base pipe to block fluid communication between the wellbore and the non-selected filtration layer. Additionally, seals are provided between the perforated outer shroud and the second solid outer shroud to prevent fluid communication between the selected filtration layer and the non-selected filtration layer.

In S1640, the well screen assembly is deployed by being lowered into to a depth in the wellbore. For example, connection ends of the well screen assembly may be coupled to a tubing string that will be lowered into the wellbore. Hoisting equipment at the surface may may be used to lower the tubing string into the wellbore. The tubing string will be lowered into the well screen assembly reaches the depth at which sand control is to be performed. For example, the depth may be in a horizontal section of wellbore that will produce hydrocarbons.

In S1650, with the well screen assembly at the depth in the wellbore, a fluid exiting the wellbore flow through the perforated outer shroud and into the selected filtration layer. For example, the fluid flow through perforations in the perforated outer shroud to contact the selected filtration layer.

In S1660, the selected filtration layer filters the specified size of particulates from the fluid. For example, the aperture size of the selected filtration layer is smaller than the specified size of particulates. This prevents the specified size of particulates from flowing through the selected filtration layer and into the interior bore. The selected filtration layer only allows a clean filtered fluid to flow through the fluid passageways of the bore into the interior bore. From the interior bore, the clean filtered fluid is transport up the tubing string to produce hydrocarbons without unwanted solids at the surface.

Examples of the above aspects include:

Example 1 is a well screen assembly for use in filtering a fluid in a wellbore comprising: a base pipe defining an interior bore, the base pipe comprising fluid passageways configured to provide fluid communication between an exterior of the base pipe and the interior bore for the fluid; filtration layers disposed around the base pipe at different axial locations along the base pipe, each filtration layer configured to filter particulates from the fluid as the fluid flows through the filtration layers and into the interior bore; and outer shrouds each disposed about a respective filtration layer and removably coupled to the base pipe, the outer shrouds comprising either solid outer shrouds blocking fluid communication between an exterior of each outer shroud and a respective filtration layer or perforated outer shrouds allowing fluid communication between the exterior and the respective filtration layer, wherein a configuration of solid or perforated outer shrouds is based on which filtration layers are selected for use in filtering the fluid in the wellbore.

Example 2 includes the aspects of any preceding examples or combinations thereof and further includes the well screen assembly of example 1, wherein each outer shroud is a solid outer shroud.

Example 3 includes the aspects of any preceding examples or combinations thereof and further includes the well screen assembly of example 1, wherein the outer shrouds comprising at least one solid outer shroud and at least one perforated outer shroud, the perforated outer shroud is configured to be about a selected filtration layer of the filtration layers based on filtering a specified size of particulates in the fluid.

Example 4 includes the aspects of any preceding examples or combinations thereof and further includes the well screen assembly of example 1, further comprising a locking mechanism configured to lock the outer shrouds to the base pipe.

Example 5 includes the aspects of any preceding examples or combinations thereof and further includes the well screen assembly of example 1, wherein each filtration layer comprises an aperture size configured to filter a specified size of particulates from the fluid.

Example 6 includes the aspects of any preceding examples or combinations thereof and further includes the well screen assembly of example 5, wherein the aperture size is an opening having a size of 300 microns, 200 microns, or 125 microns.

Example 7 includes the aspects of any preceding examples or combinations thereof and further includes the well screen assembly of example 1, further comprising a seal disposed between adjacent outer shrouds and configured to prevent a flow of the fluid between respective adjacent filtration layers.

Example 8 is a method for filtering a fluid in a wellbore with a well screen assembly, the method comprising: selecting a configuration of solid and perforated outer shrouds of the well screen assembly based on which filtration layers to block or expose to filter a specified size of particulates from the fluid, wherein the well screen assembly comprises a base pipe defining an interior bore and comprising fluid passageways configured to provide fluid communication between the wellbore and the interior bore for the fluid, the filtration layers being disposed around the base pipe at different axial locations along the base pipe and each filtration layer configured to filter particulates from the fluid as the fluid flows through the filtration layers and into the interior bore; lowering the well screen assembly to a depth in the wellbore; flowing the fluid through each perforated outer shroud and into the respective filtration layer to filter the particulate from the fluid; and flowing filtered fluid through the fluid passageways and into the interior bore.

Example 9 includes the aspects of any preceding examples or combinations thereof and further includes the method of example 8, wherein selecting the configuration of solid and perforated outer shrouds further comprising replacing a solid outer shroud with a perforated outer shroud about a selected filtration layer of the filtration layers.

Example 10 includes the aspects of any preceding examples or combinations thereof and further includes the method of example 8, further comprising locking, with a locking mechanism, each perforated outer shroud and each solid outer shroud to the base pipe.

Example 11 includes the aspects of any preceding examples or combinations thereof and further includes the method of example 8, further comprising disposing a seal around the base pipe between each perforated outer shroud and each solid outer shroud to prevent fluid communication between a selected filtration layer and the non-selected filtration layer.

Example 12 includes the aspects of any preceding examples or combinations thereof and further includes the method of example 8, further comprising selecting a selected filtration layer having an aperture size corresponding to the specified size of particulates.

Example 13 includes the aspects of any preceding examples or combinations thereof and further includes the method of example 12, wherein the aperture size is an opening having a size of 300 microns, 200 microns, or 125 microns.

Example 14 includes the aspects of any preceding examples or combinations thereof and further includes the method of example 8, further comprising disposing one of the perforated outer shroud about the selected filtration layer.

Example 15 includes the aspects of any preceding examples or combinations thereof and further includes the method of example 8, further comprising transporting the filtered fluid up a tubing string connected to the base pipe.

Example 16 is a system comprising: a tubing string within a wellbore; a base pipe connected in the tubing string, the base pipe defining an interior bore and comprising fluid passageways configured to provide fluid communication between the wellbore and the interior bore; filtration layers disposed around the base pipe at different axial locations along the base pipe, each filtration layer configured to filter particulates from a fluid of the wellbore as the fluid flows through the filtration layers and into the interior bore; and outer shrouds disposed about respective filtration layers and removably coupled to the base pipe, the outer shrouds comprising either solid outer shrouds blocking fluid communication between an exterior of each outer shroud and a respective filtration layer or perforated outer shrouds allowing fluid communication between the exterior and the respective filtration layer, wherein a configuration of solid and perforated outer shrouds is based on selected filtration layers for use in filtering the fluid from the wellbore.

Example 17 includes the aspects of any preceding examples or combinations thereof and further includes the system of example 16, wherein each outer shroud is a solid outer shroud.

Example 18 includes the aspects of any preceding examples or combinations thereof and further includes the system of example 16, wherein the outer shrouds comprising at least one solid outer shroud and at least one perforated outer shroud, the perforated outer shroud is configured to be about a selected filtration layer of the filtration layers based on filtering a specified size of particulates in the fluid.

Example 19 includes the aspects of any preceding examples or combinations thereof and further includes the system of example 16, further comprising a locking mechanism configured to lock the outer shrouds to the base pipe.

Example 20 includes the aspects of any preceding examples or combinations thereof and further includes the system of example 16, further comprising a seal disposed between adjacent outer shrouds and configured to prevent a flow of the fluid between respective adjacent filtration layers.

Certain terms are used throughout the description and claims to refer to particular features or components. As one skilled in the art will appreciate, different persons may refer to the same feature or component by different names. This document does not intend to distinguish between components or features that differ in name but not function. It is to be further understood that the various embodiments described herein may be used in various stages of a well (land and/or offshore), such as rig site preparation, drilling, completion, abandonment etc., and in other environments, such as work-over rigs, fracking installation, well-testing installation, oil and gas production installation, without departing from the scope of the present disclosure. Wherever possible, like or identical reference numerals are used in the figures to identify common or the same elements. The figures are not necessarily to scale and certain features and certain views of the figures may be shown exaggerated in scale for purposes of clarification.

For the aspects and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various aspects of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of information. Such a user interface can be operated in conjunction with the communications unit and the bus. Various components of the system can be integrated such that processing identical to or similar to the processing schemes discussed with respect to various aspects herein can be performed.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about", "approximately", "substantially", and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The aspects disclosed should not be interpreted, or otherwise used, as limiting the scope of the disclosure, including the claims. It is to be fully recognized that the different teachings of the aspects discussed may be employed separately or in any suitable combination to produce desired results. In addition, one skilled in the art will understand that the description has broad application, and the discussion of any aspect is meant only to be exemplary of that aspect, and not intended to suggest that the scope of the disclosure, including the claims, is limited to that aspect.

What is claimed is:

1. A well screen assembly for use in filtering a fluid in a wellbore comprising:

a base pipe defining an interior bore, the base pipe comprising fluid passageways configured to provide fluid communication between an exterior of the base pipe and the interior bore for the fluid;

filtration layers disposed around the base pipe at different axial locations along the base pipe, each filtration layer configured to filter particulates from the fluid as the fluid flows through the filtration layers and into the interior bore; and outer shrouds each disposed about a filtration layer and removably coupled to the base pipe, each outer shroud comprising either a solid outer shroud blocking fluid communication from outside the outer shroud to the filtration layer or a perforated outer shroud allowing fluid communication from outside the outer shroud to the filtration layer, wherein, for each filtration layer, the outer shroud is selectively interchangeable with either a solid outer shroud or a perforated outer shroud to block or allow fluid communication with the respective filtration layer, and wherein a configuration of solid or perforated outer shrouds is based on which filtration layers are selected for use in filtering the fluid in the wellbore.

2. The well screen assembly of claim 1, wherein each outer shroud is a solid outer shroud.

3. The well screen assembly of claim 1, wherein the outer shrouds comprise at least one solid outer shroud and at least one perforated outer shroud and at least one perforated outer shroud is configured to be about a selected filtration layer of the filtration layers based on filtering a specified size of particulates in the fluid.

4. The well screen assembly of claim 1, further comprising a locking mechanism configured to lock the outer shrouds to the base pipe.

5. The well screen assembly of claim 1, wherein each filtration layer comprises an aperture size configured to filter a specified size of particulates from the fluid.

6. The well screen assembly of claim 5, wherein the aperture size is an opening having a size of 300 microns, 200 microns, or 125 microns.

7. The well screen assembly of claim 1, further comprising a seal disposed between adjacent outer shrouds and configured to prevent a flow of the fluid between respective adjacent filtration layers.

8. A method for filtering a fluid in a wellbore with a well screen assembly, the method comprising:

selecting a configuration of interchangeable solid and perforated outer shrouds of the well screen assembly based on which filtration layers to block from or expose to fluid communication outside of the outer shrouds to filter a specified size of particulates from the fluid, wherein the well screen assembly comprises a base pipe defining an interior bore and comprising fluid passageways configured to provide fluid communication between the wellbore and the interior bore for the fluid, the filtration layers being disposed around the base pipe at different axial locations along the base pipe and each filtration layer configured to filter particulates from the fluid as the fluid flows through the filtration layers and into the interior bore;

lowering the well screen assembly to a depth in the wellbore;

flowing the fluid through each perforated outer shroud and into the respective filtration layer to filter the particulate from the fluid; and flowing filtered fluid through the fluid passageways and into the interior bore.

9. The method of claim 8, wherein selecting the configuration of solid and perforated outer shrouds further comprises replacing a solid outer shroud with a perforated outer shroud about a selected filtration layer of the filtration layers.

10. The method of claim 8, further comprising locking, with a locking mechanism, each perforated outer shroud and each solid outer shroud to the base pipe.

11. The method of claim 8, further comprising disposing a seal around the base pipe between each perforated outer shroud and each solid outer shroud to prevent fluid communication between a selected filtration layer and the non-selected filtration layer.

12. The method of claim 8, further comprising selecting a selected filtration layer having an aperture size corresponding to the specified size of particulates.

13. The method of claim 12, wherein the aperture size is an opening having a size of 300 microns, 200 microns, or 125 microns.

14. The method of claim 8, further comprising disposing one of the perforated outer shroud about the selected filtration layer.

15. The method of claim 8, further comprising transporting the filtered fluid up a tubing string connected to the base pipe.

16. A system comprising:

a tubing string within a wellbore;

a base pipe connected in the tubing string, the base pipe defining an interior bore and comprising fluid passageways configured to provide fluid communication between the wellbore and the interior bore;

filtration layers disposed around the base pipe at different axial locations along the base pipe, each filtration layer configured to filter particulates from a fluid of the wellbore as the fluid flows through the filtration layers and into the interior bore; and outer shrouds each disposed about a filtration layer and removably coupled to the base pipe, each outer shroud comprising either a solid outer shroud blocking fluid communication from outside the outer shroud to the filtration layer or a perforated outer shroud allowing fluid communication from outside the outer shroud to the filtration layer, wherein, for each filtration layer, the outer shroud is selectively interchangeable with either a solid outer shroud or a perforated outer shroud to block or allow fluid communication with the respective filtration layer, and wherein a configuration of solid and/or perforated outer shrouds is based on selected filtration layers for use in filtering the fluid from the wellbore.

17. The system of claim 16, wherein each outer shroud is a solid outer shroud.

18. The system of claim 16, wherein the outer shrouds comprise at least one solid outer shroud and at least one perforated outer shroud and at least one perforated outer shroud is configured to be about a selected filtration layer of the filtration layers based on filtering a specified size of particulates in the fluid.

19. The system of claim 16, further comprising a locking mechanism configured to lock the outer shrouds to the base pipe.

20. The system of claim 16, further comprising a seal disposed between adjacent outer shrouds and configured to prevent a flow of the fluid between respective adjacent filtration layers.

* * * * *